United States Patent [19]

Sato et al.

[11] Patent Number: 4,820,064

[45] Date of Patent: Apr. 11, 1989

[54] ELECTRONIC HAND LABELER

[75] Inventors: Yo Sato, Tokyo; Tadao Kashiwaba, Iwate, both of Japan

[73] Assignee: Kabushiki Kaisha Sato, Japan

[21] Appl. No.: 60,621

[22] Filed: Jun. 10, 1987

[30] Foreign Application Priority Data

Jun. 10, 1986 [JP] Japan ..... 61-132713

[51] Int. Cl.[4] ..... B41J 3/20; B65C 11/02

[52] U.S. Cl. ..... 400/120; 400/175; 101/288

[58] Field of Search ..... 400/120, 175; 101/288

[56] References Cited

U.S. PATENT DOCUMENTS

| | | | |
|---|---|---|---|
| 4,075,944 | 2/1978 | Conley | 101/288 |
| 4,170,422 | 10/1979 | Bilek | 400/55 |
| 4,176,603 | 12/1979 | Sato | 101/288 |
| 4,257,327 | 3/1981 | Sato | 101/288 |
| 4,432,830 | 2/1984 | Jue | 101/288 |
| 4,439,777 | 3/1984 | Aprato | 400/120 |
| 4,452,667 | 6/1984 | Chang | 101/288 |
| 4,518,454 | 5/1985 | Fujita | 101/288 |
| 4,530,611 | 7/1985 | Borcenk et al. | 400/56 |
| 4,549,825 | 10/1985 | Fish, III et al. | 400/175 |
| 4,555,715 | 11/1985 | Vegeais et al. | 400/175 |
| 4,560,292 | 12/1985 | Takahashi | 101/288 |
| 4,584,048 | 4/1986 | Hamisch, Jr. et al. | 101/288 |
| 4,685,815 | 8/1987 | Baranyi | 400/55 |
| 4,695,850 | 9/1987 | Nubson | 400/120 |
| 4,706,095 | 11/1987 | Ono et al. | 400/120 |

FOREIGN PATENT DOCUMENTS

| | | | |
|---|---|---|---|
| 0126902 | 12/1984 | European Pat. Off. | 101/288 |
| 2407820 | 7/1979 | France | 400/56 |
| 134762 | 8/1983 | Japan | 400/56 |
| 73878 | 4/1985 | Japan | 400/56 |
| 105551 | 6/1985 | Japan | 400/55 |
| 2161757 | 1/1986 | United Kingdom | 101/288 |

*Primary Examiner*—William Pieprz

*Attorney, Agent, or Firm*—Ostrolenk, Faber, Gerb & Soffen

[57] ABSTRACT

A hand held thermal printer has a hingedly mounted bottom cover which can be opened to provide comfortable access into the printer and therefore substantially simplified loading of a roll of labels into the printer. The platen roller of the printer which normally abuts the print head of the printer is supported on a pivotable platen arm. The platen arm, like the bottom cover can be pivoted to an open position to provided direct access to the print head. The print head is held in place by a retainer plate which is held by screws and the screws can be simply loosened to permit the print head to be easily replaced. In the open position of the platen arm a wide and straight label passage is created through which the leading end of the backing sheet on which the labels are located could be easily threaded into the printer.

14 Claims, 8 Drawing Sheets

FIG. 5
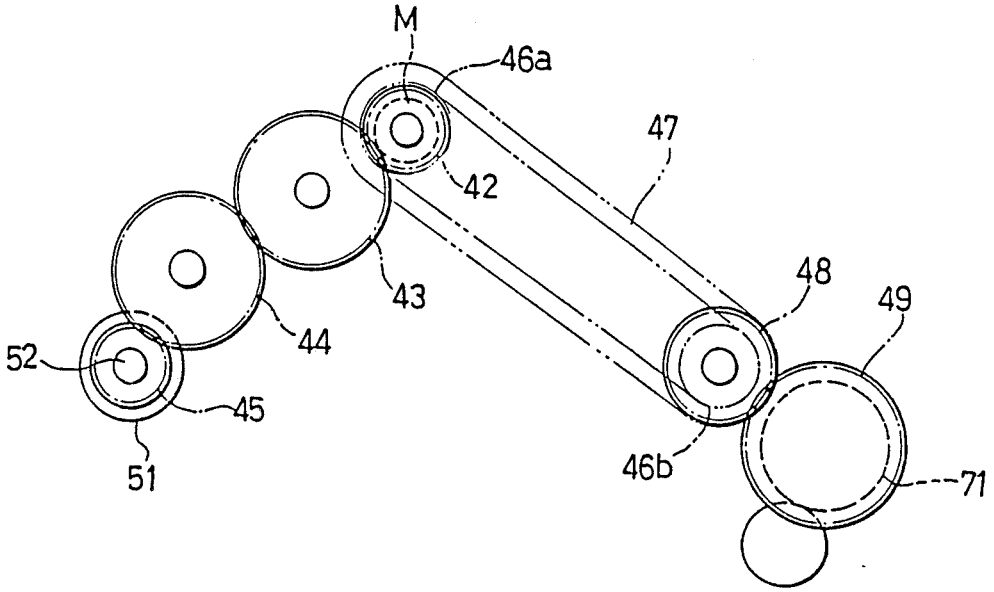
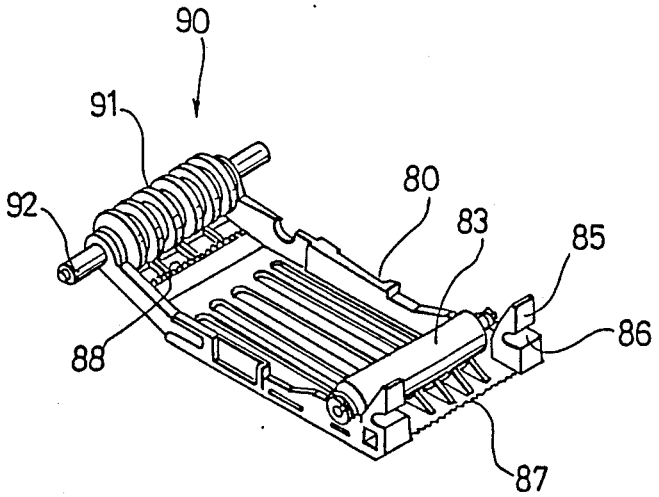
FIG. 7

ELECTRONIC HAND LABELER

BACKGROUND OF THE INVENTION

This invention relates to a portable electronic labeler having a thermal print head. More specifically, the invention relates to a hand held and easily carried label printer and applicator which is suited for marking prices on merchandise and printing labels with price bar codes. The labeler can be interfaced to an optical reader or the like to read the price bar code and as such it may be used, for example, at checkout counters Stationary, desktop-type printers are often used for printing labels and for applying the labels to merchandise. Such desktop printers are however large and heavy and require that the merchandise be brought to the printer. This and the cumbersome way in which the labels are attached to the merchandise makes the overall process of printing and applying labels inefficient.

Portable label printing and attaching devices ("hand labelers") are often used in place of the bulkier desktop printers. However, hand labelers are not as sophisticated as desktop printers and are more likely to produce errors in handling data such as prices, check sum digits and the like. They also produce an inferior printing quality, which is of concern particularly with respect to bar code printing where precision in printing is important.

Accordingly, the present invention provides an electronic hand labeler with a thermal print head which incorporates the more desirable features of both desktop printers and hand labelers to thus provide good overall operational efficiency and high precision in printing.

Conventional hand labelers provide label-trip threading systems wherein a roll of strip-shaped labels is loaded in a label transport section which is located in a main body portion of the hand labeler. Rotating transport rollers in the hand labeler which are coupled to a motor move the strip of labels automatically to a thermal head portion which is located toward the front region of the hand labeler. Thereafter, the labels are peeled off from a leading end of a backing sheet on which they are located and that backing sheet is bent backward over a bending pin. The backing sheet is drawn toward the rear in the hand labeler where a pair of motor driven guide rollers engage the backing sheet by traction to pull it out of the housing of the hand labeler.

This conventional, motor-driven threading system has many drawbacks including the need to expend extra time and follow a complex procedure to load the labels in the hand labeler.

SUMMARY OF THE INVENTION

Accordingly, it is an object of the present invention to provide a hand labeler with a manual system for loading roll of labels therein.

It is another object of the present invention to provide a hand labeler having a simpler means for loading a roll of labels thereinto.

It is yet another object of the invention to provide a manual loading system for loading a hand labeler which employs a loading technique which is improved over previously known loading systems such as are disclosed for example in the present Applicants' Japanese Laid-open application No. 52 (1977)-12080 entitled "Label Applicator" (corresponding to U.S. Pat. No. 5,026,758) and Utility Model No. 57 (1982)-37697) entitled "Label Roll Threading Apparatus" (corresponding to U.S. Pat. No. 4,176,603).

The foregoing and other objects of the invention are realized with an electronic, thermal-head, hand labeler which permits the label strip operation to proceed reliably, quickly and easily via a manual threading system which allows the labels to be loaded in a single operation.

The main unit of the hand labeler of the present invention is provided with a pivotably mounted and openable bottom cover which is disposed along an inner side thereof. On the same side with the openable bottom cover, the hand labeler is provided with a platen arm having a platen roller which is so positioned that it abuts and lies against a thermal print head in the labeler. The platen arm which supports the platen roller is itself pivotable in a direction which is opposed to the rotational direction of the bottom cover . The platen arm is linked to a label retainer member which during operation of the hand labeler keeps the labels flat against a guide passage surface in the hand labeler. The construction of the hand labeler is such that opening the bottom cover and releasing the platen arm from its usual location pivots the label retaining member in a manner which creates a straight and unusually large, inclined guide surface through which the leading end of the roll of labels can be threaded easily and quickly, in a single operation.

Other features and advantages of the present invention will become apparent from the following description of the invention which refers to the accompanying drawings

BRIEF DESCRIPTION OF THE DRAWINGS

FIG. 5 shows the drive transmission for the platen roller and the traction/transport roller of the printer-labeler unit.

FIG. 7 is a perspective view of a label cutting device which is provided on the bottom cover of the printer-labeler unit.

DETAILED DESCRIPTION OF THE PREFERRED EMBODIMENTS

Figure 1:
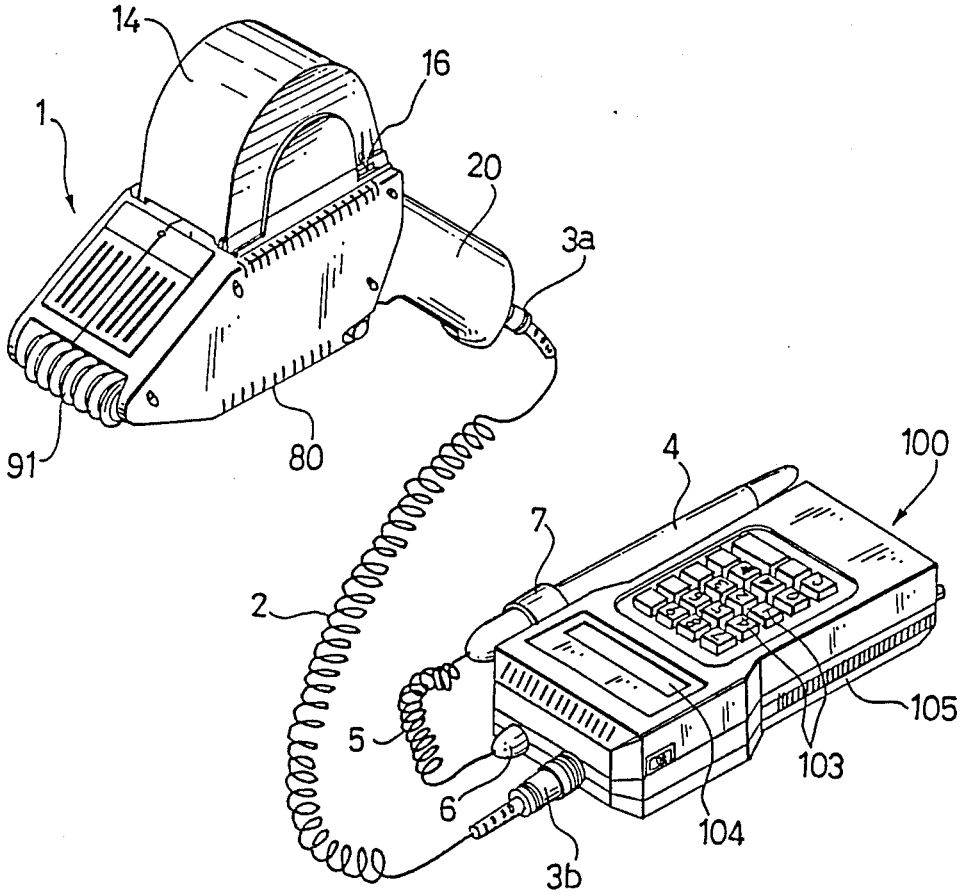
FIG. 1 is a perspective view of a printer-labeler unit, a control unit and a pen scanner setup according to a first embodiment of the invention.

Referring to FIG. 1, an electronic hand labeler of the present invention includes a printer-labeler unit 1 that is suited for single-hand operation; a separate, self-contained, control unit 100 which is connected by a cable 2 to printer-labeler unit 1; and a pen scanner 4 which is connected to control unit 1 by cable 5. All of these are portable and may be carried n a person's pocket or hung on his belt.

Control unit 100 includes keyboard 103, display 104, batteries 105, and a holder 7 for holding pen scanner 4 Reference numerals 3a, 3b and 6 denote cable plugs.

Figure 2:
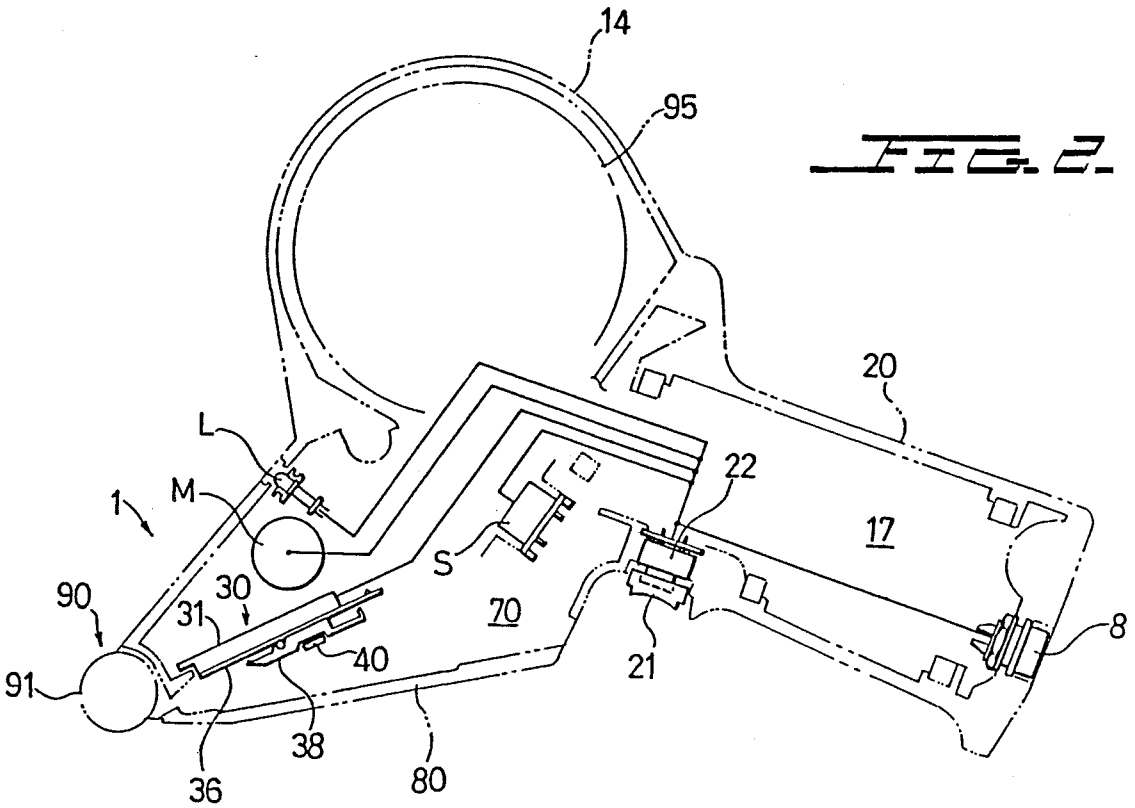
FIG. 2 is a side view of the printer-labeler unit shown in FIG. 1.
Figure 3A:
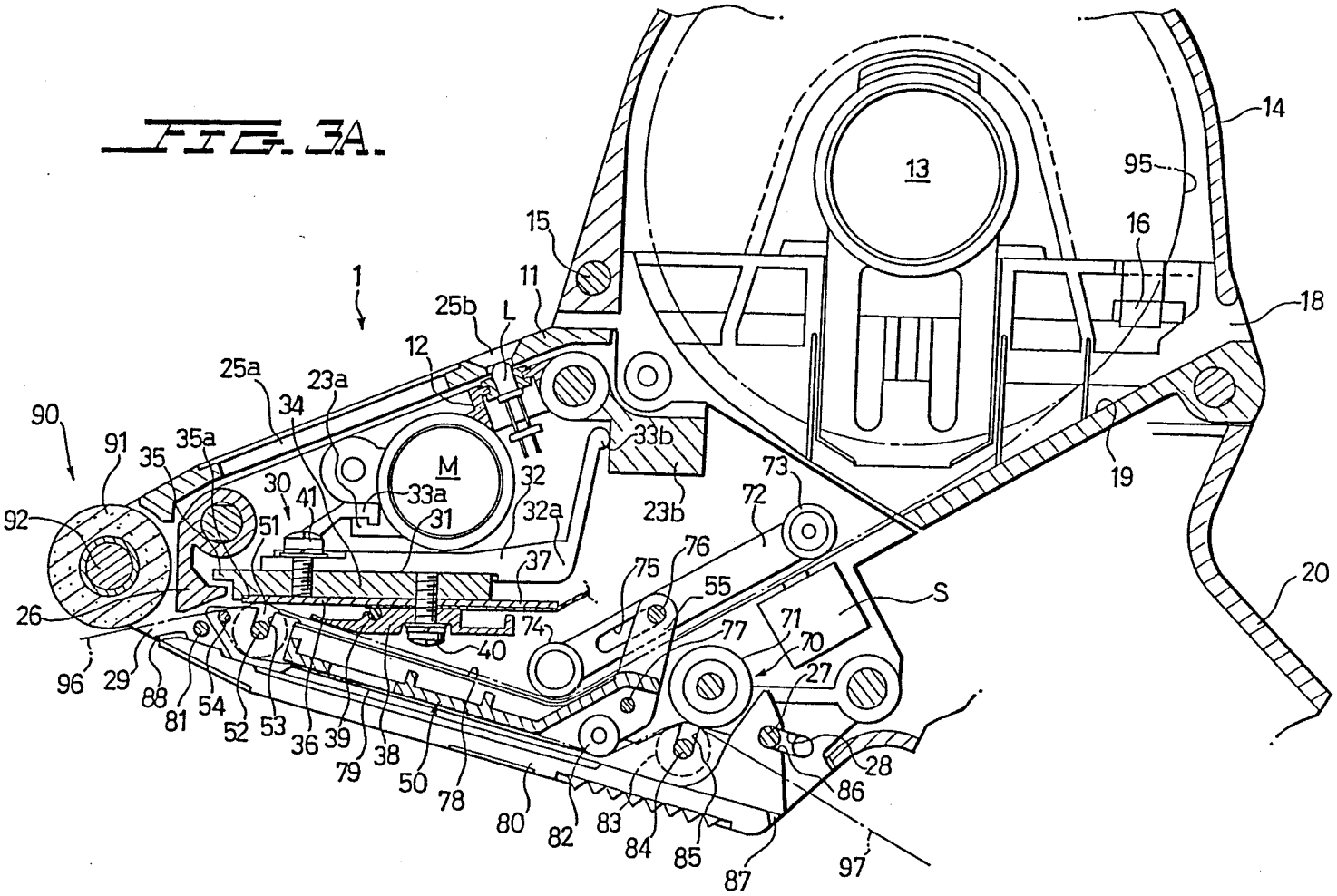
FIG. 3A is an enlarged cross-sectional view of the main parts of the printer-labeler unit.
Figure 3B:
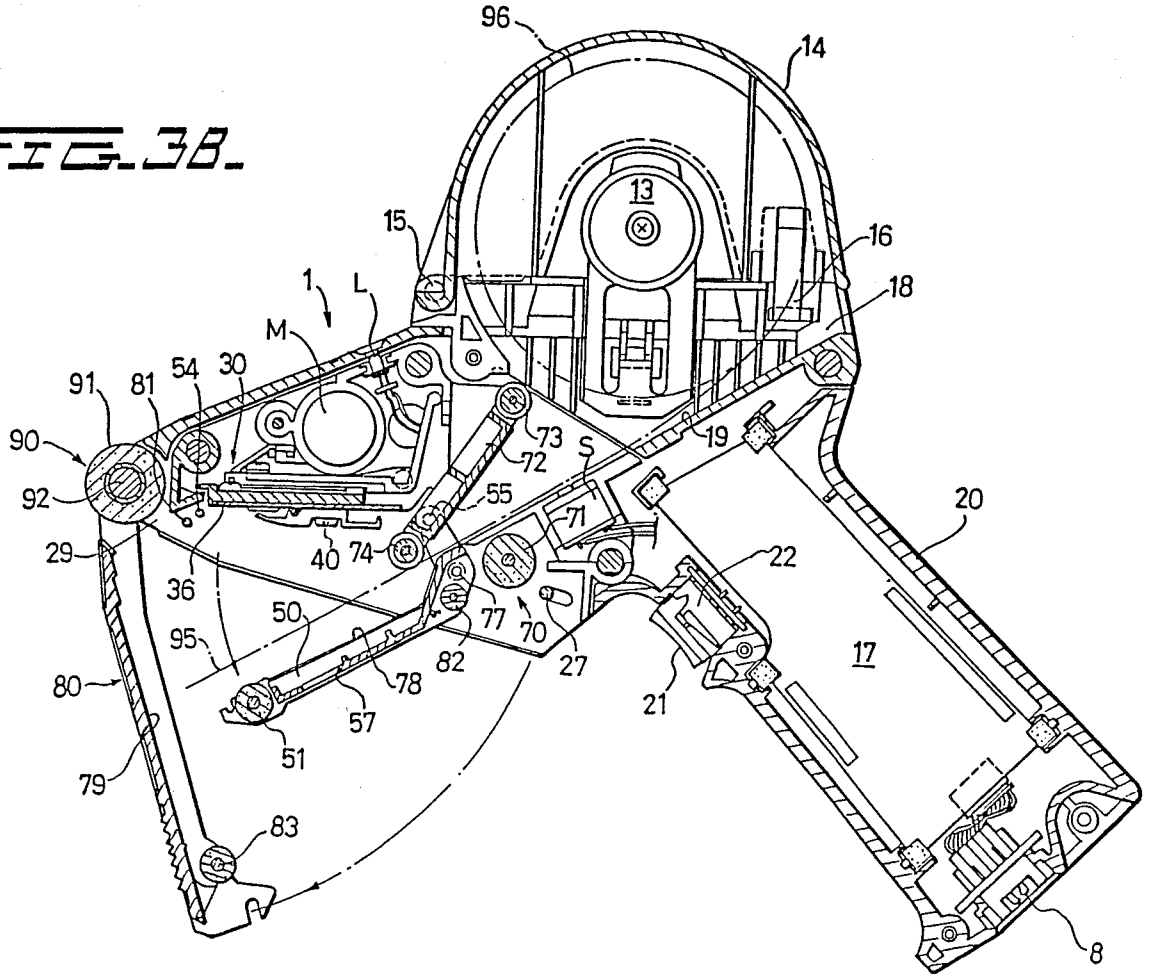
FIG. 3B shows the label routing, through the labeler of FIG. 1, with the printer-labeler unit cover and platen arm in an open position.

Referring to FIGS. 2, 3A and 3B, a label web holder 13 for holding a continuous roll 95 of thermal-labels is provided on the upper portion of an outer frame 11 of printer-labeler unit 1. A grip 20 which allows the unit to be gripped and operated single-handedly is at the rear of holder 13. Within the interior of outer frame 11, which defines a labeler housing, is disposed a label printing and dispensing mechanism which includes a thermal printing device 30, a label transporting device 70 and a label applicator 90. At label holder 13, an approximately semicircular label case 14, which encases the label roll 95, is affixed to a spindle 15 which is located at the forward part of outer frame 11. Case 14 is easily openable around spindle 15 toward the front of the labeler. In its illustrated closed position, the case 14 is engaged by an engaging portion 16.

As seen in FIGS. 1 and 2, grip 20 houses a microswitch 22 which is operated by a push button 21. Microswitch 22 is detachably connected to connector 8 and from there to the plug 3a of cable 3. That cable is connected to batteries 105 disposed inside control unit 100. Microswitch 22 is also connected to thermal printhead 36 of a thermal printing device 30, to motor M of a label transport device 70, to diode type emission reflection lamp L and to reflection type sensor S.

Figure 6:
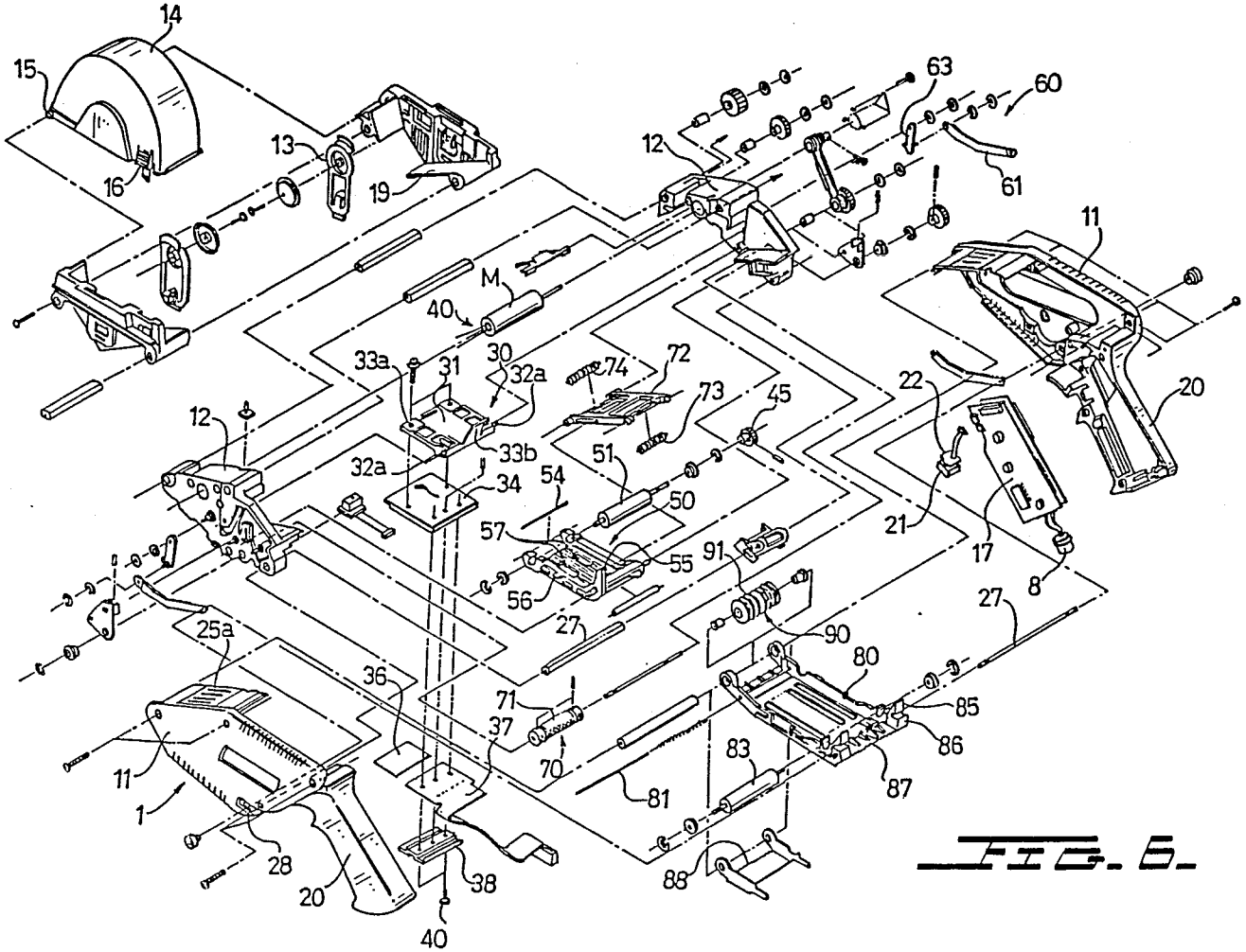
FIG. 6 is an exploded perspective view of the printer-labeler unit.

The thermal printing device 30, as seen in FIGS. 3A, 3B and 6, is attached to an inner frame 12 provided. at one portion of outer frame 11. Device 30 is comprised of a combination of a thermal unit 31 and a platen roller 51. More specifically, a heat radiation member 34 of a unit baseplate 32 is attached to the thermal unit 31 by a fixing screw 41. A thermal print head 36 is attached, by means of a thermal print head retainer plate 38, an 0-ring 39 and a fixing screw 40, to the forward portion of heat radiation member 34. A flexible ribbon cable 37 is connected to thermal print head 36 and extends toward the rear thereof, and O-ring 39 is arranged at the join portion to provide a secure attachment. The ribbon cable 37 is wired to connector 8 via the microswitch 22, the wiring of ribbon cable 37 being effected at circuit board 17 which is located in grip 20.

The entire thermal unit 31 is secured to inner frame 12 by a pair of mounting bosses 32a which are provided on baseplate 32 and which engage socket portions in inner frame 12 in a manner which enables the front part of thermal unit 31 to swing. A stepped portion 35a formed at the front edge of heat radiation member 34 is spaced from and opposes main unit fixing portion 26.

Two resilient engaging members 33a and 33b are disposed on the upper region of thermal unit 31. Engaging members 33a and 33b are constructed of a springy material and are attached to the baseplate 32. The free ends of engaging members 33a and 33b abut, respectively, motor fixing portion 23a and unit fixing portion 23b, in inner frame 12.

Thermal print head 36 is positioned at the lower front surface portion of thermal unit 31 and is aligned into position with the help of an alignment step portion 35a formed on heat radiation member 34. Thus, only when the front edge of the thermal print head 36 fits into step portion 35a is the thermal print head 36 resiliently urged into its correct position. The above arrangement assures correct alignment of thermal print head 36 relative to platen roller 51 which is located opposite the head. Through-holes 25a carry away heat generated by motor M and hole 25b provides a window for lamp L.

The platen roller 51 is normally urged against the thermal print head 36 by the resilience of engaging members 33a and 33b and that roller is rotatably mounted on platen arm 50. Platen roller 51 rotates on spindle 52. The ends of the spindle are housed in retainer portions 53 consisting of cutouts in the frame of platen arm 50. Motor M drives platen roller 51. Information is imprinted on thermal labels 96 as platen roller 51 both moves and presses the labels against thermal print head 36. At the tip of the platen roller 51, backing sheet 97 bends sharply around bending pin 54 to cause thermal labels 96 to peel off backing sheet 97. Platen arm 50 is supported on pivot 77 to pivot counterclockwise as seen in FIG. 3B.

A label retainer member 72, the movement of which is interlocked with the rotation of platen arm 50, is provided in the main unit. A coupling pin 76, disposed on coupling portion 55 and curving upwardly toward the back of platen arm 50, is fitted into a slot 75 in label retainer member-72. Moving together with platen arm 50, label retainer member 72 pivots about fixed guide roller 74 which is located at one end of the label retainer member 72, such that the movable guide roller 73 which is located at the other end on retainer member 72 is displaced away from the solid line toward the double-dot chain line. Therefore, guide rollers 73 and 74 which are ordinarily in contact with the inclined label guide passage surface 19, which is located below label holder 13, become separated from the label guide passage surface 19 to form a wide label insertion passage.

For pulling backing sheet 97 around bending pin 54, there is a label transport device 70 which includes traction roller 71 located near and generally below label retainer member 72. Traction roller 71 is driven by motor M. A pressure roller 83 is set inside lower casing 80 to exert a pressure on traction roller 71. As a result, the strip-like backing sheet 97 is held tightly between rollers 71 and 83 and is driven by the rotation of these rollers out through the rear of the main unit. The section of the backing sheet 97, which extends between traction roller 71 and bending pin 54, is therefore taut to provide reliable peeling of the thermal labels 96 from backing sheet 97.

Although roller 71 engages backing sheet 97 by friction, other pulling arrangements for pulling the backing sheet may be envisioned. One such alternate embodiment may include an engagement roller comprised of, for example, a rotating member having radially extending engaging pins along its circumference for engaging conveying holes or perforations provided in the backing sheet 97. Thus, rotation of the engagement roller will produce the desired driving of backing sheet 97.

The details of the mechanical interconnection of motor M to platen roller 51 and traction roller 71 are illustrated in FIG. 5. Thus, rotation of motor M is transmitted to platen roller 51 through rotation of motor gear wheel 42 whose rotation is in turn communicated via intermediate gear wheels 43 and 44 which mesh with a gear wheel 45 with which platen roller 51 is coaxially mounted. Traction roller 71 is also rotated by motor M because the motor is coupled thereto via belt 47 which is mounted on pulleys 46a and 46b . The belt 47 rotates gear wheel 48 which in turn rotates traction roller gear wheel 49 of traction roller 71.

It is desired that traction roller 71 be driven at a higher speed than platen roller 51. This is needed in order to apply extra traction to backing sheet 97 downstream of platen roller 51. Stated differently, the section of the backing sheet 97 between platen roller 51 and traction roller 71 must be taut to reliably separate labels 96 from backing sheet 97.

A bottom cover 80 to cover the bottom of the main unit is mounted to pivot about a spindle 92 which is part of label applicator roller 91. Thus bottom cover 80 is openable by being pivoted clockwise with respect to spindle 92. In its closed state, bottom cover 80 encloses an auxiliary peeling pin 81 which is located adjacent to bending pin 54 of platen arm 50. The other end of bottom cover 80 supports a pressure roller 83 which lies adjacent a backing-sheet guide roller 82 .Pressure roller 83 is supported on a spindle 84 which is provided with ends which fit into retaining slots 85 which are provided in the frame of bottom cover 80.

Insets 86 which are also located at the rear end of bottom cover 80 accommodate a resiliently-urged set pin 27 that is fitted into guide slot 28 which is formed in outer frame 11.

Figure 4:
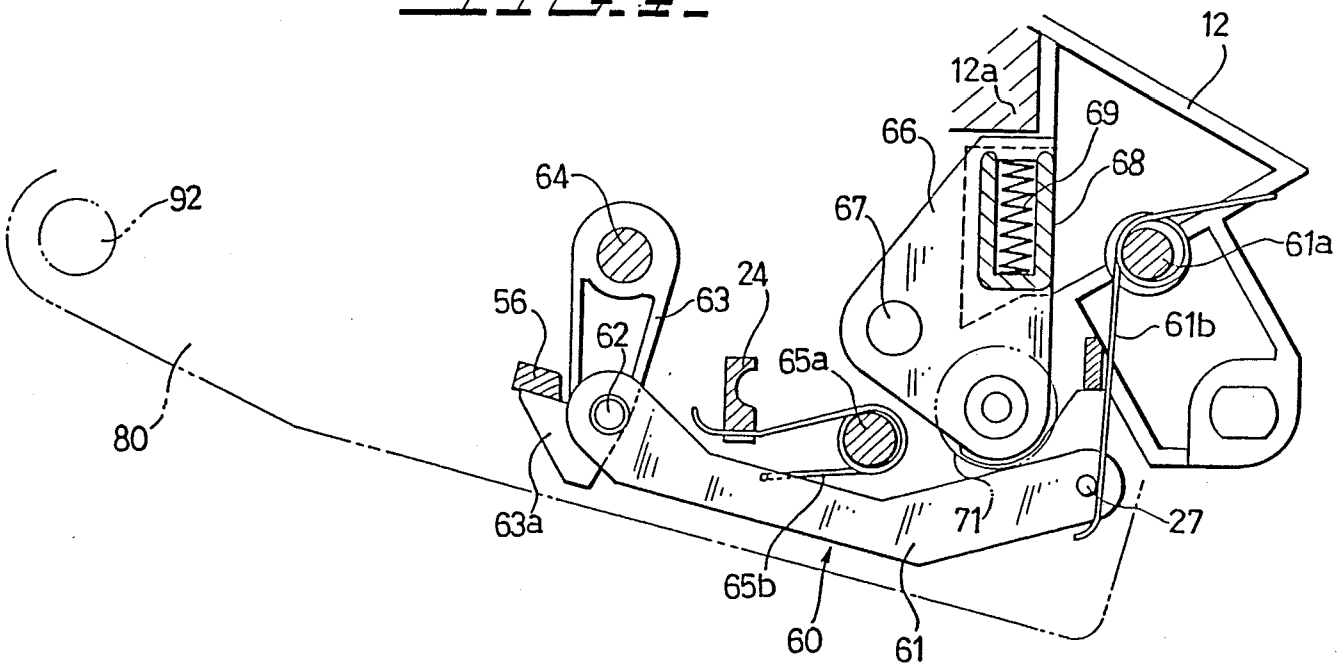
FIG. 4 is a partially cutaway side view of the platen arm retaining device of the printer-labeler unit.

Set pin 27 is interlocked with a retaining device 60 which is associated with platen arm 50, as depicted in FIG. 4. Specifically, a link 61 brings set pin 27 in contact with a spring **61*b* which spring is mounted on a spring shaft 61*a* which is in turn attached to inner frame 12 Spring 61*b* urges link 61 toward the front—that is to the left in FIG. 4. Thus, spring 61*b* urges pin 27 toward the left end of guide slot 28**.

A coupling pin 62 serves to attach a hook 63 to the end of link 61. Hook 63 is pivotable about a shaft 64 and is provided with a tip in the form of an engaging portion **63*a* which is suitable for engaging and disengaging with an engaging projection 56 which is formed on platen arm 50, as better seen in FIG. 6. A spring shaft 65*a* which is secured to inner frame 12 supports a spring 65*b*. One end of spring 65*b* fits against platen arm 50 and the other end thereof abuts against the spring stops 24. Platen arm 50 is thereby urged in a counterclockwise direction and thus facilitates opening of platen arm 50**.

Inner frame 12 supports, in addition, a backing-sheet roller arm 66 which is designed to urge traction roller 71 against pressure roller 83 of bottom cover 80. Roller arm 66 is mounted pivotably on fulcrum shaft 67 and is provided with a housing portion 68 in which there is located a spring 69 which abuts against a step portion **12*a* on inner frame 12. Consequently, the entire roller arm 66** is urged to rotate in a clockwise direction.

Traction roller 71, which is located on the lower part of roller arm 66, is therefore also urged in a clockwise direction. As a result, the backing sheet 97, which is guided between traction roller 71 and pressure roller 83, is caused to be paid out from the rear of the main unit. Simultaneously, any slip which may develop between the fast moving traction roller 71 and the backing sheet 97 is taken up by the action of spring 69 which is provided in roller arm 66. As shown in FIGS. 3B and 6, a screw driver access hole 57 is provided in platen arm 50. Access hole 57 is positioned so that it is in alignment with the fixing screw 40 of thermal printing device 30, when platen arm 50 is in its inclined open position.

One side of platen arm 50 is provided with an engaging projection 56 which serves to engage an engaging portion **63*a* of hook 63**.

The bottom cover 80, as may been seen in FIGS. 3A, 6 and 7, is provided at its rear with a rear cutter 87 for cutting sections of backing sheet 97 which emerge from the rear of the main unit. A front cutter 88, located toward the front of bottom cover 80, enables a strip of thermal label roll 95 to be cut as required for the operational mode wherein the labeler is used for producing label strips.

The operation of threading label strips into the hand labeler may be understood by reference to FIGS. 3A, 3B and 4. Thus the loading operation begins with opening bottom cover 80. For this, an operator would use his fingers to pull set pin 27 toward the rear of the labeler. The backward movement of set pin 27 along slot 28 and against the force of spring **61*b*,set pin 27 moves the pin from engaging slot 86 so as to release bottom cover 80. Bottom cover 80 then swings open, following a clockwise direction as it pivots about roller shaft 92** under the force of gravity.

As set pin 27 is being pulled backward platen arm 50 is simultaneously caused to rotate about its pivot 77. As may be seen in FIG. 4, the rightward movement of set pin 27 urges spring 61 in a backward direction resulting in the locked rotation of the hook 63 in a counterclockwise direction about its pivot shaft 64. Rotation of hook 63 results in the disengagement of hook portion **63*a* from projection 56 on platen arm 50. Therefore, with the help of gravity and the force from spring 65*b*, platen arm 50 will rotate clockwise about its pivot 77**.

The intercoupling between platen arm 50 and retainer member 72 causes the latter to move in synchronization with platen arm 50 in a counterclockwise direction whereby it pivots about its fixed guide roller 74. Consequently, retainer member 72 is cleared off guide passage surface 19 and at the same time the label guide passage surface 78 of platen arm 50 is also displaced to create a widely open label passage which is aligned along a straight line. Thus, solely by displacing platen arm 50 a large straight space is created for threading thermal-label roll 95 to thus render the threading procedure to be extremely simple and reliable.

As a following step, thermal-label roll 95 is drawn out and is smoothly guided along the inclined straight line of label guide passage surface 78 which is defined by label guide passage surface 19 and the label guide passage surface 78 on platen arm 50. The leading end of thermal-label roll 95 is drawn out and is redirected over bending pin 54 to lie along a backing sheet passage 79 on bottom cover 80.

The thermal labels 96 on the leading end of the label roll which is bent backward over backing sheet passage 79 are peeled off by hand. With the leading end in place, platen arm 50 is rotated clockwise about its pivot 77 from the open position which is shown in FIG. 3B to assume the closed position which is illustrated in FIG. 3A. At the same time the disengaged engaging means 60 becomes engaged as projection 56 on platen arm 50 engages hook portion **63*a* of hook 63, moving against the resistance of spring 65*b***.

Figure 8:
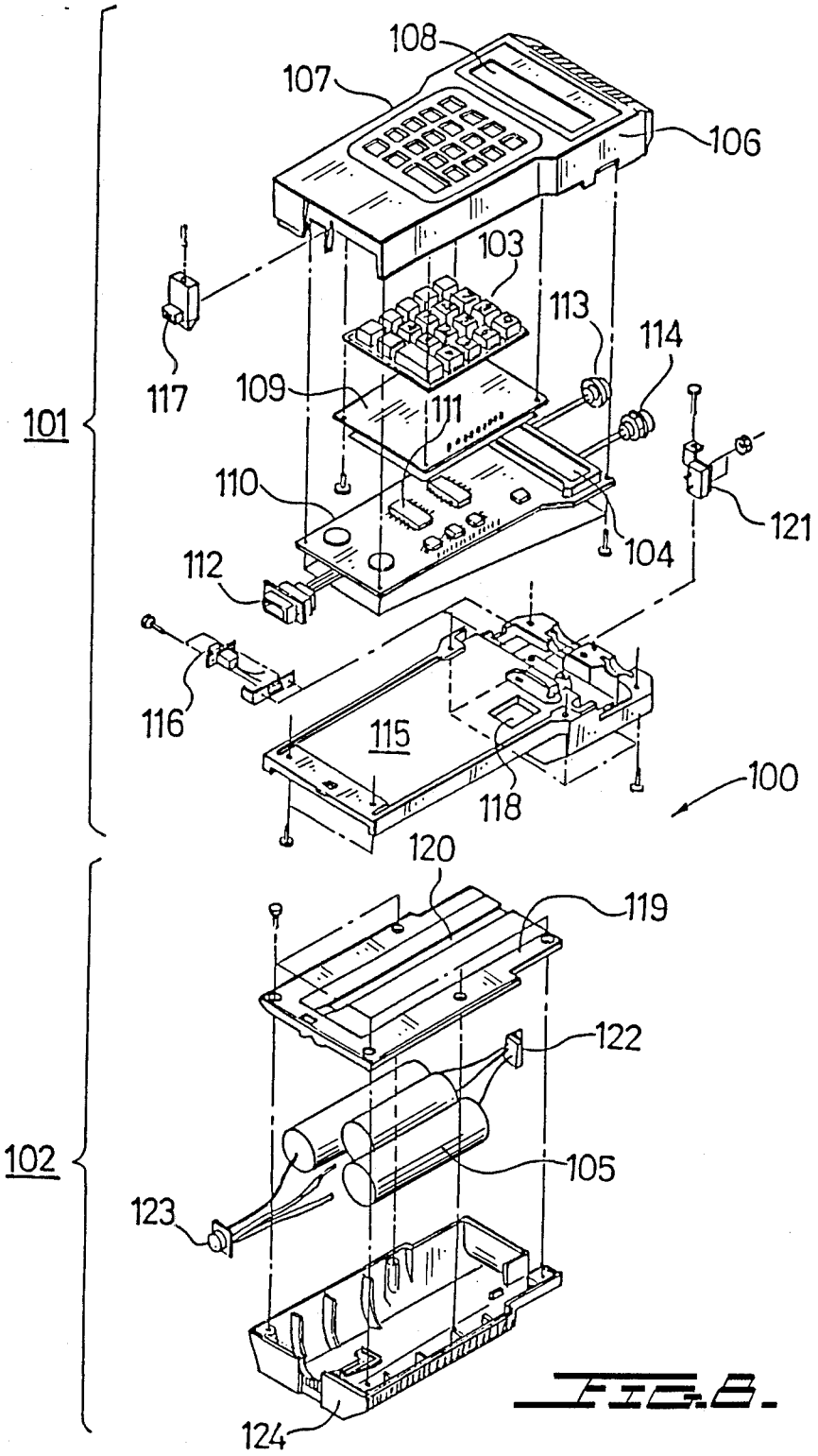
FIG. 8 is an exploded perspective view of the control unit including a keyboard, a display and batteries.

The threading operation is completed with closing bottom cover 80 by rotation thereof counterclockwise about its roller shaft 92. The engaging slot 86 of bottom cover 80 then engages set pin 27 which moves against the action of spring **61*b* to lock bottom cover 80 in place Data for printing a bar code on the labels is derived from control unit 100 seen in FIG. 8. Control unit 100 is a self contained unit, independent of printer-label unit 1, and includes in it the main keyboard 103, display 104 and batteries 105. Control unit 100 has a controller section 101 which includes the keyboard 103, the display 104 and a battery section 102 which holds batteries 105**.

Controller section 101 includes a cover 106 having a keyboard face plate 107 which fits over keyboard 103 and a display window 108 which fits over display 104. An electronic component circuit board 110 includes a connector for interfacing to the keyboard 103, an electronic device board 109, display 104 and electronic devices 111. Connector 113 connects control unit 100 to the printer-label unit 1 and connector 114 provides a connection to pen scanner 4. Controller section 101 further includes a support frame 115 which is provided with a switch 116.

Battery section 102 has a battery cover 119 and a dovetail groove 120 formed thereon. Batteries 105 are coupled to connector 123, to enable the batteries to be connected to an outside power source for recharging batteries 105.

Connector 122, which is also connected to batteries 105, is electrically coupled to a plug 121 of controller section 101 to provide a path for the flow of electrical power from the batteries 105 to controller section 101. Battery section 102 has a lower cover 124.

Battery section 102 is mechanically coupled to controller section 101 by the inter-engagement of the dovetail groove 120 on the battery cover 119 and a hook member 117 provided at controller section 101. The hook member 117 is guided by the dovetail groove 120 to engage a junction opening 118, which is provided in support frame 115, and is held by battery section 102 and controller section 101 by its natural resiliency.

Reference is now made to FIGS. 2, 3A, 3B, 5 and 8 for a description of the operation of the present embodiment, involving the printing of bar codes on the thermal labels 96.

In operation, switch 116 at control unit 100 is switched to an ON position and data that is to be printed on the labels in inputted via the keys of keyboard 103. Typically, a merchandise code and a price of the merchandise or the like are keyed into control unit 100. Thereafter the number of labels that are to be printed is entered. Control unit 100 automatically generates check sum digits for the inputted data and displays the check sum digits on the display 104.

Subsequently, during a first printing stage, microswitch 22 is activated to an ON position by pressing push button 21 on printer-label unit 1. Thereupon and in accordance with electrical commands from the control section 100 certain heating elements in thermal print head 36 are caused to heat up in a manner which causes a bar code of a certain pattern to appear on the thermally sensitive thermal labels 96 which are pressed by platen roller 51 against the print head 36.

Motor M is energized to cause platen roller 51 to rotate by a given amount to advance thermal label roll 95 on platen roller 51 by a set distance. At the same time, traction roller 71 is similarly rotated via the action of belt 47 and gear wheels 48 and 49.

The movement of thermal label roll 95 causes thermal labels 96 to peel from thermal label roll 95 at backing sheet bending pin 54. The activation of motor M, platen rollers 51 and traction roller 71 is repeated until all the information on one label is imprinted thereon.

Following completion of the printing of one label, thermal label roll 95 advances further until a sensing mark (not shown) which is located on the back side of the strip-shaped backing sheet 97 is detected by a sensor S.

The thermal labels 96 are thus sequentially conveyed past print head 36 and are then peeled from the strip-shaped backing sheet at sheet bending pin 54. They are then guided out from the labeler unit 1 via an outlet 29. The peeled labels are temporarily held by a label application section 90.

The labels move below a label applicator 91 and rest on an auxiliary peeling pin 81. An operator carrying the printer-labeler unit 1 by its grip 20 is on which the printed bar code has been formed to the article.

The labeler unit senses when a preset number of labels have been produced and thereafter causes the electrical and mechanical operations of the labeler unit 1 to cease.

The labeler of the present invention is also provided with computer-like on-line capabilities. Connector 112 of control unit 100 may be connected to a personal computer and data from the personal computer itself or from the semiconductor or disk memory of the personal computer may be communicated to the printer-labeler unit 1 for specifying the type and particulars of the information that is to appear on the thermal labels. Data may also be entered to printer-labeler unit 1 via pen scanner 4.

The thermal print head 36 of the present invention can be replaced easily by following the below outlined procedure which refers to FIGS. 3A, 3B and 6. Platen arm 50, as was noted, is provided with screw driver access holes 57. Access holes 57 include a pair of screw driver holes which become aligned with fixing screws 40 on thermal printing device 30, when platen arm 50 is in its open position. To replace a worn or defective print head 36, platen arm 50 is opened and a screw driver (not shown) or the like is inserted through access holes 57 and operated to loosen fixing screws 40. That loosens thermal print head retainer plate 38 which together with O-ring 39 holds print head 36 in place. Print head 36 is then simply withdrawn and a new replacement print head 36 is substituted therefor.

The substitute thermal print head 36 is aligned into position with the help of alignment step portion **35*a* which is formed on heat radiation member 34. The installation of print head 36 is completed by tightening fixing screw 40 and connecting flexible ribbon cable 37 carefully to thermal print head 36** to avoid damage thereto.

Thus, print head 36 is easily replaced by loosening retainer plate 38 of thermal unit 31. This is far simpler and easier as compared to conventional hand labelers in which the print head 36 is a replacement part of the entire thermal unit 31. In conventional hand labelers all elements including unit baseplate 32, heat radiation member 34, print head 36 and retainer plate 38 must be handled. Replacement of a prior art print head is complicated and costly.

Thermal unit 31, like print head 36, can be easily replaced. As was noted, the entire thermal unit 31 is secured to inner frame 12 by a pair of mounting bosses **32*a* which are provided on baseplate 32 and which engage socket portions in inner frame 12. Two resilient engaging members 33*a* and 33*b* are disposed on the upper region of thermal unit 31. Engaging members 33*a* and 33*b* are constructed of a springy material and are attached to the baseplate 32. The free ends of engagement members 33*a* and 33*b* abut, respectively, motor fixing portion 23*a* and unit fixing portion 23*b*, in inner frame 12. Accordingly, the entire thermal unit 31** could be easily mounted within the main unit of the hand labeler of the present invention.

Thus, the present invention dispenses with the screws and various other adjusting means of conventional labelers for installing and aligning the print head and the thermal unit. Moreover, the print head and the platen roller 51 of the present invention are self aligned.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A labeler, comprising:

a labeler housing which defines an interior for supporting a label printing mechanism therein;

an openable bottom cover mounted to the labeler housing;

thermal print head supported in the labeler housing for printing information on labels which are conveyed through the labeler, means for securing the print head in the labeler and further means for loosening the securing means to allow the print head to be individually withdrawn from the interior, said securing means including a retainer plate for supporting the print head in the interior of the labeler, a baseplate which is mounted to the labeler housing and a screw for coupling the retainer plate to the baseplate, the screw being capable of being tightened to hold the print head tightly in place;

a platen arm mounted in the interior of the labeler and disposed generally between the bottom cover and the print head, the platen arm being movable between a closed position and an open position, the platen arm including screw-driver-access opening therein which opening is aligned, when the platen arm is in said open position, with the screw to enable the screw to be reached and tightened by a tool which is insertable through the platen arm;

a platen roller supported on the platen arm and so positioned on the platen arm that in the closed position of the platen arm the platen roller lies adjacent the print head; and means for rotating the platen roller to thereby cause a backing sheet to which the labels are detachably attached to be conveyed past the print head.

2. A labeler as in claim 1, further including renewal unit for absorbing heat from the print head, the print head being in heat conducting contact with the thermal unit.

3. A labeler as in claim 2, further including mounting means on the baseplate for supporting the baseplate resiliently against the labeler housing so that when the platen arm is in its closed position the print head which is coupled to the baseplate bears resiliently against the platen roller of the platen arm.

4. A labeler as in claim 3, in which the mounting for the baseplate includes first engaging members on one side of the baseplate and second engaging members spaced from the first engaging members, the first and second engaging members having respective free ends which are coupled to the frame of the labeler and which are constructed of a springy material to allow the print head to bear resiliently against the platen roller.

5. A labeler as in claim 3, in which the thermal unit includes an alignment formation and wherein the print head is aligned relative to the alignment formation of the thermal unit.

6. A labeler as in claim 3, further an O-ring disposed between the print head and the retainer member for holding the print head in place.

7. The labeler of claim 1, further including a first pivot and the bottom cover being pivotable about the first pivot between an open position and a closed position.

8. A labeler as in claim 7, further including a second pivot and the platen arm being pivotable about the second pivot between an open position and a closed position thereof.

9. A labeler as in claim 8, further including an engaging projection on the platen arm and means for latching the engaging projection to lock the platen arm in its closed position.

10. A labeler as in claim 8, in which the platen arm and the bottom cover are so relative to each other that, in the respective open position of the platen arm and the bottom cover, the print head is directly accessible through the bottom of the labeler.

11. A labeler as in claim 10, in which the second pivot is located away from the first pivot and in the interior of the labeler and the platen arm being pivotable in a direction opposite to a pivoting direction of the bottom cover.

12. A labeler, comprising:

a labeler housing which defines an interior for supporting a label printing mechanism therein;

an openable bottom cover mounted to the labeler housing;

a thermal print head supported in the labeler housing for printing information on labels which are conveyed through the labeler, means for securing the print head in the labeler and further means for loosening the securing means to allow the print head to be individually withdrawn from the interior, said securing means including a screw for securing the print heat tightly in place;

a platen arm mounted in the interior of the labeler and disposed generally between the bottom cover and the print head, the platen arm being movable between a closed position and an open position, the platen arm including a screw-driven-access opening therein which opening is aligned, when the platen arm is in said open position, with the screw to enable the screw to be reached and tightened by a tool which is insertable through the platen arm;

a platen roller supported on the platen arm and so positioned on the platen arm that in the closed position of the platen arm the platen roller lies adjacent the print head;

means for rotating the platen roller to thereby cause a backing sheet to which the labels are detachably attached to be conveyed past the print head; and a set pin for holding the bottom cover in its closed position, a set pin guide slot through which the set pin is movable, a link member coupled to the set pin and a hook means coupled to the link member and engageable with the platen arm to secure the platen arm in its closed position whereby the set pin is effective for releasing the hook means to cause the bottom cover and the platen arm to move simultaneously to their respective open positions.

13. A labeler as in claim 12, further including a spring for urging the platen arm toward its open position when the platen arm is disengaged from the hook means.

14. A labeler, comprising:

a labeler housing which defines an interior for supporting a label printing mechanism therein;

an openable bottom cover mounted to the labeler housing;

a thermal print head supported in the labeler housing for printing information on labels which are conveyed through the labeler, means for securing the print head in the labeler and further means for loosening the securing means to allow the print head to be individually withdrawn from the interior, the securing means including a retainer plate for supporting the print head in the interior of the labeler and a baseplate which is mounted to the labeler housing;

a platen arm mounted in the interior of the labeler and disposed generally between the bottom cover and the print head, the platen arm being movable between a closed position and an open position;

a platen roller supported on the platen arm and so positioned on the platen arm that in the closed position of the platen arm the platen roller lies adjacent the print head;

means for rotating the platen roller to thereby cause a backing sheet to which the labels are detachably attached to be conveyed past the print head; and mounting means on the baseplate for supporting the baseplate resiliently against the labeler housing so that when the platen arm is in its closed position the print head which is coupled to the baseplate bears resiliently against the platen of the platen arm, the mounting means including a first engaging member at one side edge of the baseplate and a second engaging member spaced from the first engaging member and at an oppositely located side edge of the base plate, each of the first and second engaging members having a respective free end, the labeler having socket portion means for removably receiving therein the free end of one of the engaging members, the free end of the other of the engaging member being abutted against the labeler housing, and the engaging members being constructed of a springly material to allow the print heat to bear resiliently against and to self align with the platen roller.

* * * * *